US009509078B2

(12) United States Patent
Hashimoto et al.

(10) Patent No.: US 9,509,078 B2
(45) Date of Patent: Nov. 29, 2016

(54) CONNECTOR HOUSING

(71) Applicant: Sumitomo Wiring Systems, Ltd., Yokkaichi, Mie (JP)

(72) Inventors: Norihito Hashimoto, Mie (JP); Hidefumi Horiuchi, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 14/822,985

(22) Filed: Aug. 11, 2015

(65) Prior Publication Data

US 2016/0043499 A1 Feb. 11, 2016

(30) Foreign Application Priority Data

Aug. 11, 2014 (JP) ..... 2014-163289

(51) Int. Cl.
*H01R 13/432* (2006.01)
*H01R 13/05* (2006.01)
*H01R 13/642* (2006.01)

(52) U.S. Cl.
CPC ..... *H01R 13/432* (2013.01); *H01R 13/055* (2013.01); *H01R 13/642* (2013.01)

(58) Field of Classification Search
USPC ..... 439/587, 746, 595, 752.5, 745, 489, 439/884
See application file for complete search history.

(56) References Cited

U.S. PATENT DOCUMENTS 3,982,805 A * 9/1976 Irie ..... H01R 13/4223 439/595
4,660,915 A * 4/1987 Mantlik ..... H01R 13/434 439/595
4,891,021 A * 1/1990 Hayes ..... H01R 13/114 439/595
4,969,841 A * 11/1990 Sueyoshi ..... H01R 13/4365 439/594
5,067,913 A * 11/1991 Sagawa ..... H01R 13/4223 439/595
5,435,758 A * 7/1995 Sasai ..... H01R 13/4368 439/752
5,664,969 A * 9/1997 Peterson ..... H01R 13/432 439/746
5,997,363 A * 12/1999 Joly ..... H01R 13/521 439/748
6,106,340 A * 8/2000 Myer ..... H01R 13/4367 439/595
8,337,259 B2 * 12/2012 Chen ..... H01R 13/432 439/751
8,926,363 B2 * 1/2015 Klein ..... H01R 13/533 439/587
8,961,226 B2 * 2/2015 Shinkawa ..... H01R 13/4223 439/595
9,039,447 B2 * 5/2015 Aoki ..... H01R 13/432 439/607.01
9,142,917 B2 * 9/2015 Yu ..... H01R 13/631

FOREIGN PATENT DOCUMENTS

JP 2013-098072 5/2013

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A connector housing is provided capable of reliably preventing a terminal fitting from being inserted and accommodated in a vertically inverted posture into a cavity. A connector housing includes a cavity capable of accommodating a terminal fitting provided with a projection on an outer side surface of a terminal main body portion in the form of a rectangular tube. The cavity includes a main body accommodating portion into which the terminal main body portion is to be accommodated and a groove portion into which the projection is insertable and movable forward when the terminal fitting is inserted in a proper posture into the cavity. A guiding portion for angularly displacing the terminal main body portion by coming into contact with the projection when the terminal fitting is inserted in a vertically inverted posture into the cavity is provided on a side of the cavity before the main body accommodating portion.

13 Claims, 9 Drawing Sheets

CONNECTOR HOUSING

BACKGROUND

1. Field of the Invention

The present invention relates to a connector housing.

2. Description of the Related Art

Conventionally, a connector housing is known in which terminal fittings with a stabilizer projecting on an outer side surface of a main body portion are to be accommodated. For example, in Japanese Unexamined Patent Publication No. 2013-98072, a connector housing is provided with a plurality of cavities into which terminal fittings are inserted from behind, and each cavity is formed with a groove portion into which a stabilizer is insertable and movable forward when the terminal fitting is inserted in a proper posture. If the terminal fitting is inserted into the cavity in a vertically inverted posture, the stabilizer comes into contact with an edge part of the cavity and any further inserting operation is restricted.

Generally, a cavity is narrower at a back side than at an entrance side. Thus, in inserting a terminal fitting into the cavity, insertion resistance is created at a position where the cavity becomes narrower even if the terminal fitting is inserted in a proper posture. Accordingly, with the configuration described above if the stabilizer comes into contact with the edge part of the cavity when the terminal fitting is inserted in the vertically inverted posture, an operator may mistakenly perceive it as the normal insertion resistance and continues to push the terminal fitting and the terminal fitting moves forward in the cavity while the stabilizer forcibly expands the edge part of the cavity and the terminal fitting is accommodated in the cavity.

The present invention was completed based on the above situation and aims to provide a connector housing capable of reliably preventing a terminal fitting from being inserted in a vertically inverted posture into a cavity and accommodated in the cavity.

SUMMARY OF THE INVENTION

A connector housing of the present invention includes a cavity capable of accommodating a terminal fitting provided with a projection. The projection is in the form of a rectangular tube and is formed on an outer side surface of a terminal main body portion of the terminal fitting. The cavity includes a main body accommodating portion into which the terminal main body portion is to be accommodated and a groove portion into which the projection is insertable and movable forward when the terminal fitting is inserted in a proper posture into the cavity. The cavity further includes a guiding portion on a side of the cavity in front of the main body accommodating portion for angularly displacing the terminal main body portion by coming into contact with the projection when the terminal fitting is inserted in a vertically inverted posture into the cavity.

According to the present invention, the projection is inserted into the groove portion to permit a forward movement of the terminal fitting when the terminal fitting is inserted in the proper posture into the cavity. When the terminal fitting is inserted in the vertically inserted posture, the projection comes into contact with the guiding portion to rotate the terminal main body portion and corner portions of the terminal main body portion come into contact with a peripheral edge part of the cavity. Thus, a contact force when the terminal fitting is inserted in the vertically inverted posture into the cavity is stronger, for example, than in the case where only a stabilizer comes into contact with the peripheral edge part of the cavity. Thus, even if an operator continues to push the terminal fitting, the forward movement of the terminal fitting is reliably restricted and the terminal fitting can be reliably prevented from being inserted and accommodated in the vertically inverted posture in the cavity.

In the connector housing of the present embodiment, the guiding portion may be a projection having an inclined surface. According to such a configuration, the terminal main body portion can be smoothly angularly displaced.

DETAILED DESCRIPTION

Hereinafter, one specific embodiment of the present invention is described in detail with reference to FIGS. 1 to 9. A connector housing 10 in this embodiment is configured to accommodate terminal fittings 20 provided with a projection 22. The projection is a rectangular tube and is formed on an outer side surface of a terminal main body portion 21. In the following description, a left side in FIG. 2 (front side in a connecting direction to an unillustrated mating connector) is referred to as a front side and a right side is referred to as a rear side.

Figure 4:
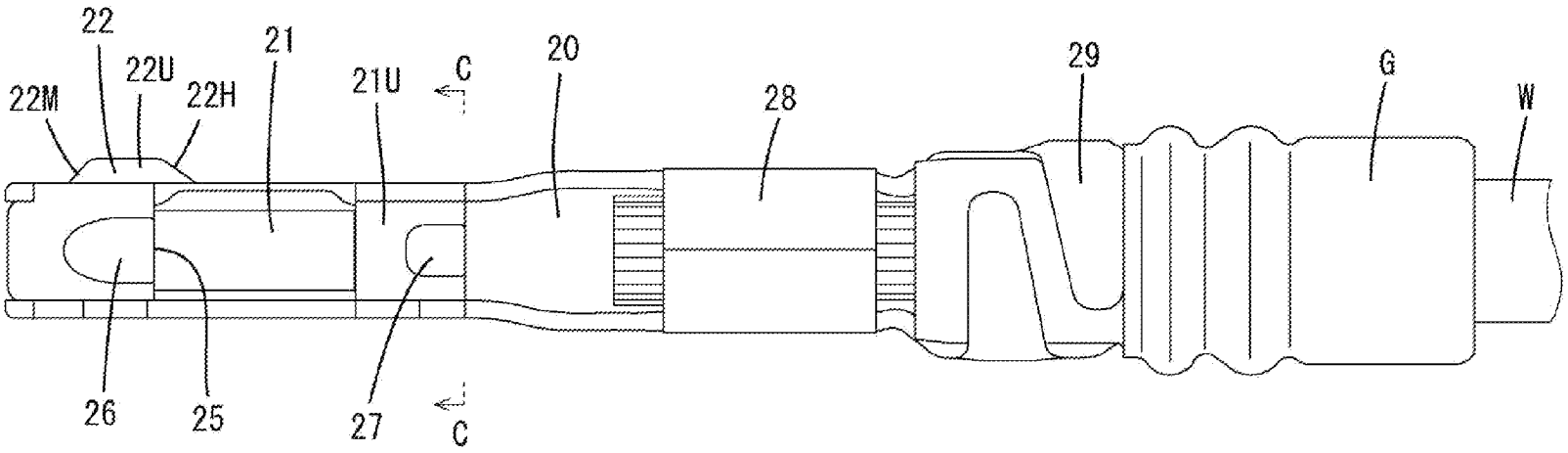
FIG. 4 is a plan view showing a terminal fitting fixed to an end part of a wire.

The terminal fitting 20 is long and narrow in a front-back direction and is formed by punching out a metal flat plate and bending the punched-out plate piece as shown in FIG. 4. The terminal fitting 20 is a female terminal fitting 20 and connectable to an unillustrated male terminal fitting.

Figure 5:
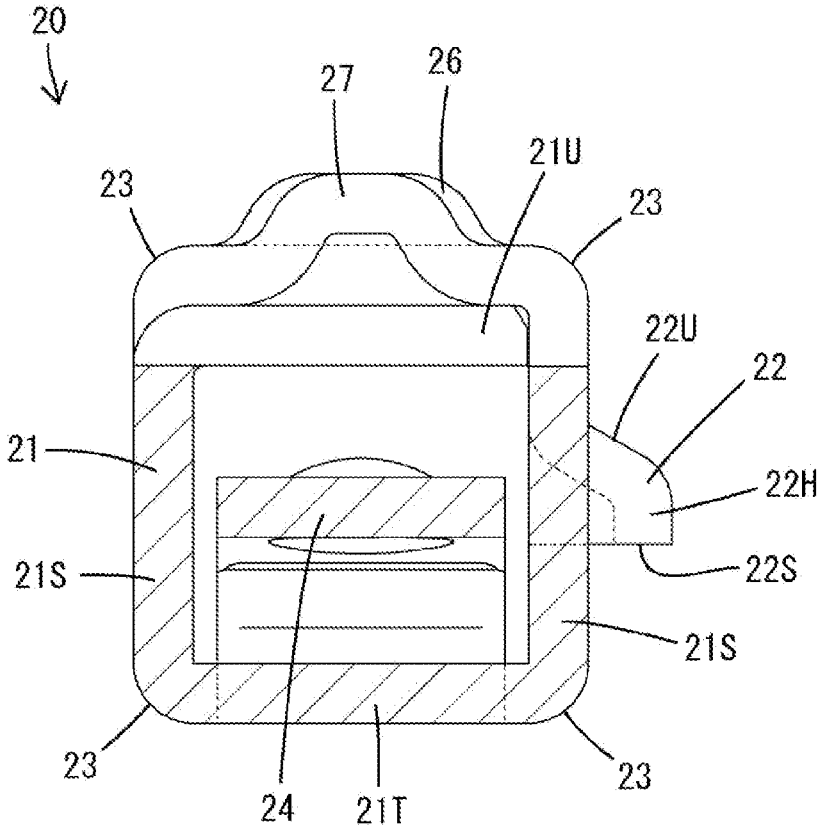
FIG. 5 is a section along C-C of FIG. 4, showing the shape of the terminal fitting.

The terminal main body portion 21 is provided on the front side of the terminal fitting 20 and is in the form of a rectangular tube into which a male tab of the mating terminal fitting is insertable from the front. As shown in FIG. 5, the terminal main body portion 21 includes a pair of side plate portions 21S standing up from opposite side edges of a bottom plate portion 21T in a width direction and an upper plate portion 21U composed of two plates bent at the upper ends of the side plate portions 21S to face the bottom plate portion 21T and is formed with four corner portions 23. A resilient piece 24 capable of resiliently sandwiching the inserted male tab is provided in the terminal main body portion 21.

A lance locking portion 25 is provided on an upper surface of the terminal main body portion and is configured for locking a locking lance 12 provided in the connector housing 10. The lance locking portion 25 is located near the front end of the terminal main body portion 21.

Further, a stabilizer 26 projects from the upper surface of the terminal main body portion 21. The stabilizer 26 is provided substantially in a widthwise center of the terminal main body portion 21 and formed into a dome shape projecting highest in a widthwise center thereof. The front surface of the stabilizer 26 is inclined downwardly toward the front and the rear surface thereof is aligned with the lance locking portion 25 in the front-back direction. Note that a protuberance 27 having a projecting distance equal to that of the stabilizer 26 and a slightly smaller width than the stabilizer 26 projects on a rear end part of the terminal main body portion 21 as shown in FIG. 5.

The projection 22 is provided on one of the pair of side plate portions 21S of the terminal main body portion 21. The projection 22 is provided substantially in a vertical center of the side plate portion 21S of the terminal main body portion 21. As shown in FIG. 4, the projection 22 is located near the front end of the terminal main body portion 21 and substantially aligned in position with the stabilizer 26 in the front-back direction. As shown in FIG. 5, an upper surface 22U of the projection 22 is inclined to increase a projecting distance from the side plate portion 21S gradually toward a lower side and a lower surface 22S of the projection 22 is substantially perpendicular to the side plate portion 21S. Further, as shown in FIG. 4, a front surface 22M of the projection 22 is inclined to gradually increase an outward projecting distance toward the back and a rear surface 22H of the projection 22 is inclined to gradually reduce an outward projecting distance toward the back. Note that the rear surface 22H of the projection 22 is more moderately inclined than the front surface 22M.

A wire barrel portion 28 and an insulation barrel portion 29 are provided on a rear part of the terminal fitting 20. The wire barrel portion 28 is configured to be swaged and fixed to a core of a wire W. The insulation barrel portion 29 is configured to be swaged and fixed to a coating portion of the wire W. A rubber plug G is also provided on a rear part of the terminal fitting 20. The rubber plug G is, for example, made of silicon and formed into a hollow cylindrical shape as a whole and a plurality of lips are provided to project at fixed intervals in the front-back direction on the outer peripheral surface of the rubber plug G.

Figure 1:
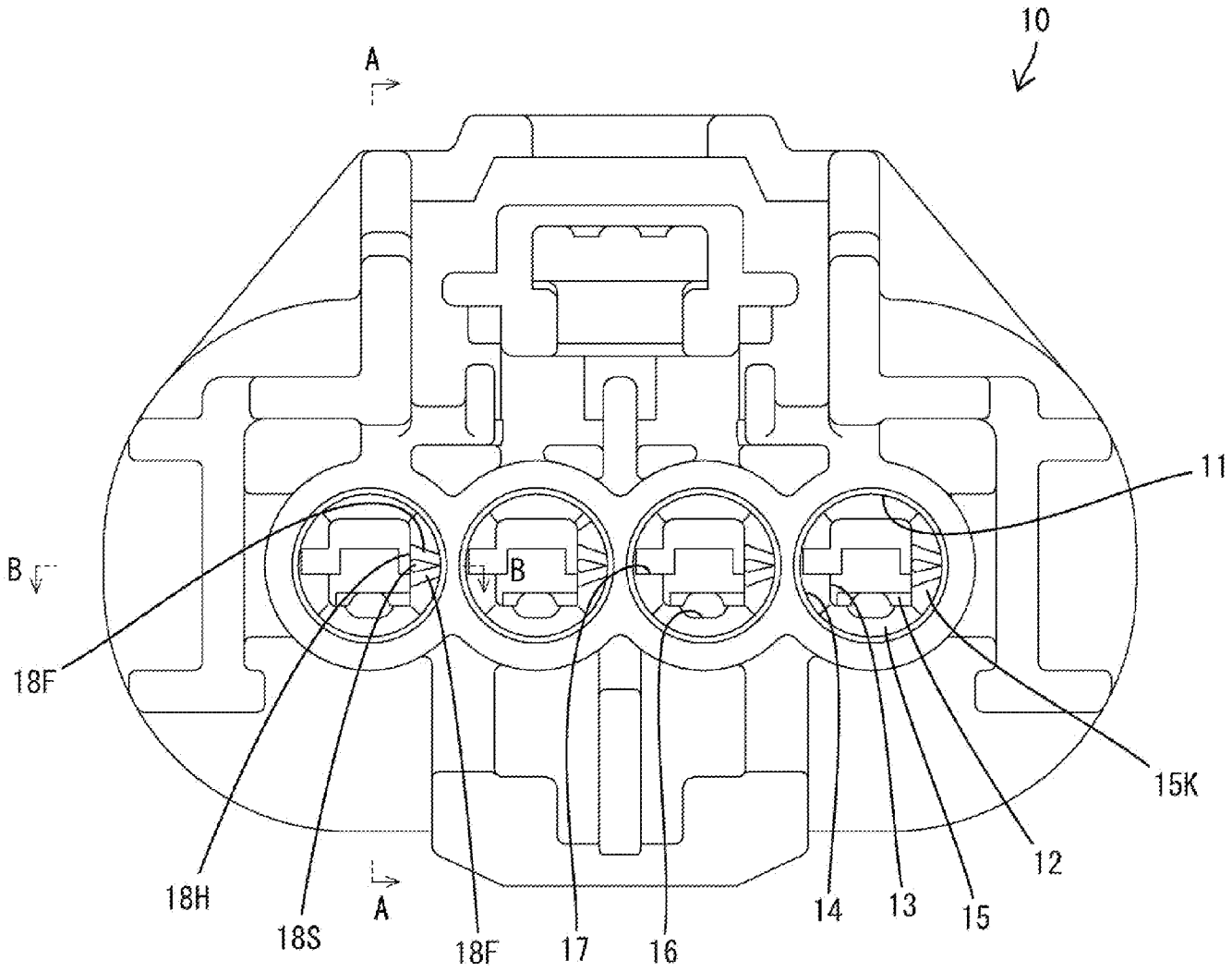
FIG. 1 is a rear view showing a connector housing.

As shown in FIG. 1, the connector housing 10 is provided with a plurality of cavities 11 into which the terminal fittings 20 are to be accommodated. The cavities 11 are provided in one stage in the connector housing 10 so that axes of the cavities are arranged in a common plane. The terminal fitting 20 is insertable into each cavity 11 from behind.

A main body accommodating portion 13 into which the terminal main body portion 21 of the terminal fitting 20 is to be accommodated is provided in a front part of each cavity 11. The main body accommodating portion 13 has a substantially rectangular cross-section conforming to the terminal main body portion 21 and is open forward. Note that an unillustrated front holder is mounted on a front surface side of the connector housing 10.

Figure 2:
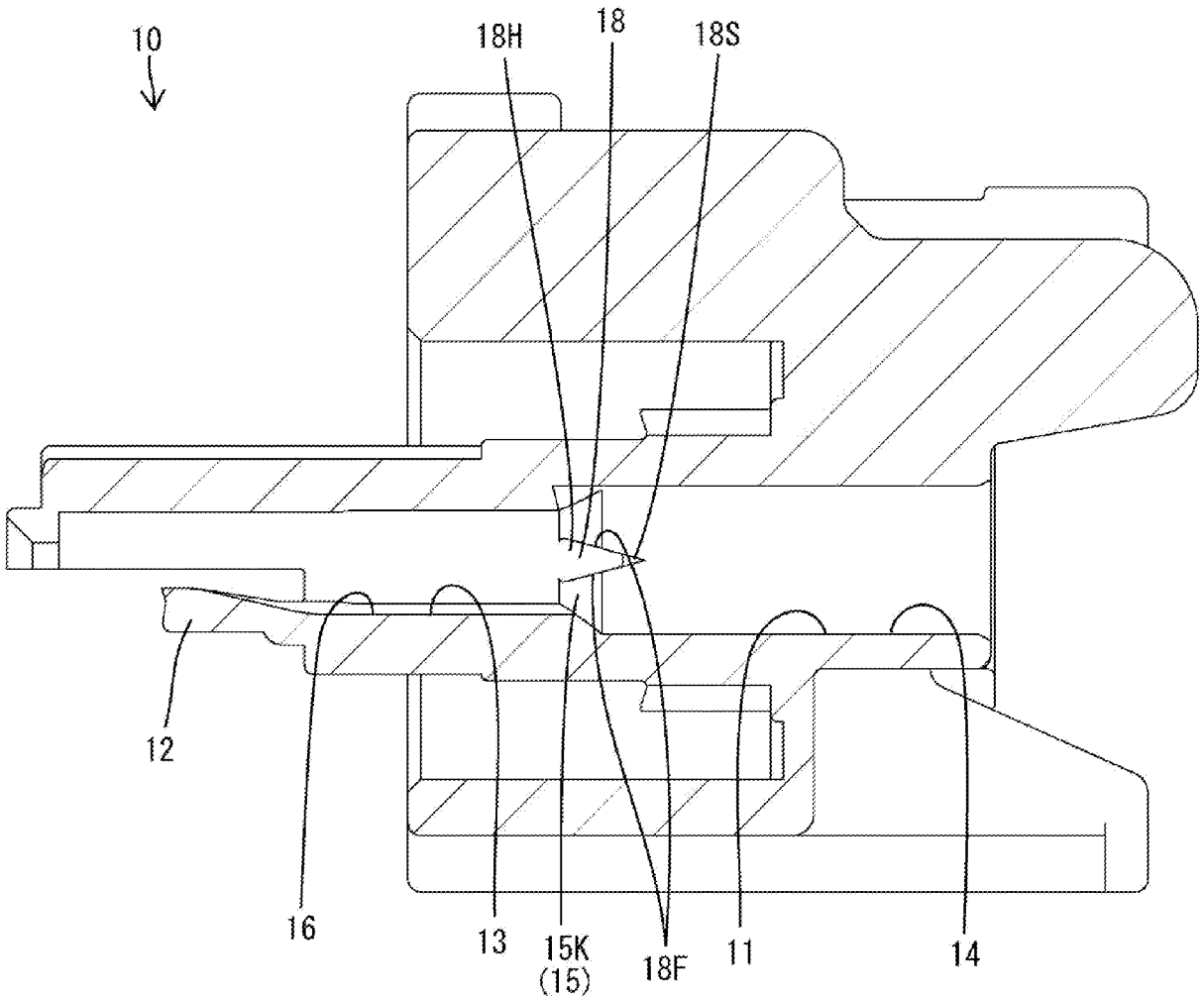
FIG. 2 is a section along A-A of FIG. 1.

As shown in FIG. 2, the locking lance 12 for locking and retaining the terminal fitting 20 is provided in each main body accommodating portion 13. The locking lance 12 is provided at the lower surface of the main body accommodating portion 13 and is cantilevered forward. A front end of the locking lance 12 is locked to the lance locking portion 25 of the terminal fitting 20 accommodated in the cavity 11. The locking lance 12 is resiliently deflectable in a vertical direction.

A rubber plug accommodating portion 14 into which the rubber plug G is to be accommodated is provided in a rear part of each cavity 11. The rubber plug accommodating portion 14 has a substantially circular cross-section and restricts the entrance of water into the cavity 11 by the close contact of the lips of the rubber plug G with the inner peripheral surface of the rubber plug accommodating portion 14.

A cross-section changing portion 15 for changing a cross-sectional shape of the cavity 11 from a substantially circular cross-section to a substantially rectangular cross-section while gradually narrowing a width of the cavity 11 in vertical and lateral directions is provided between the rubber plug accommodating portion 14 and the main body accommodating portion 13 in each cavity 11. The cross-section changing portion 15 has an inclined surface 15K which is inclined gradually from the rubber plug accommodating portion 14 toward the main body accommodating portion 13.

Figure 6:
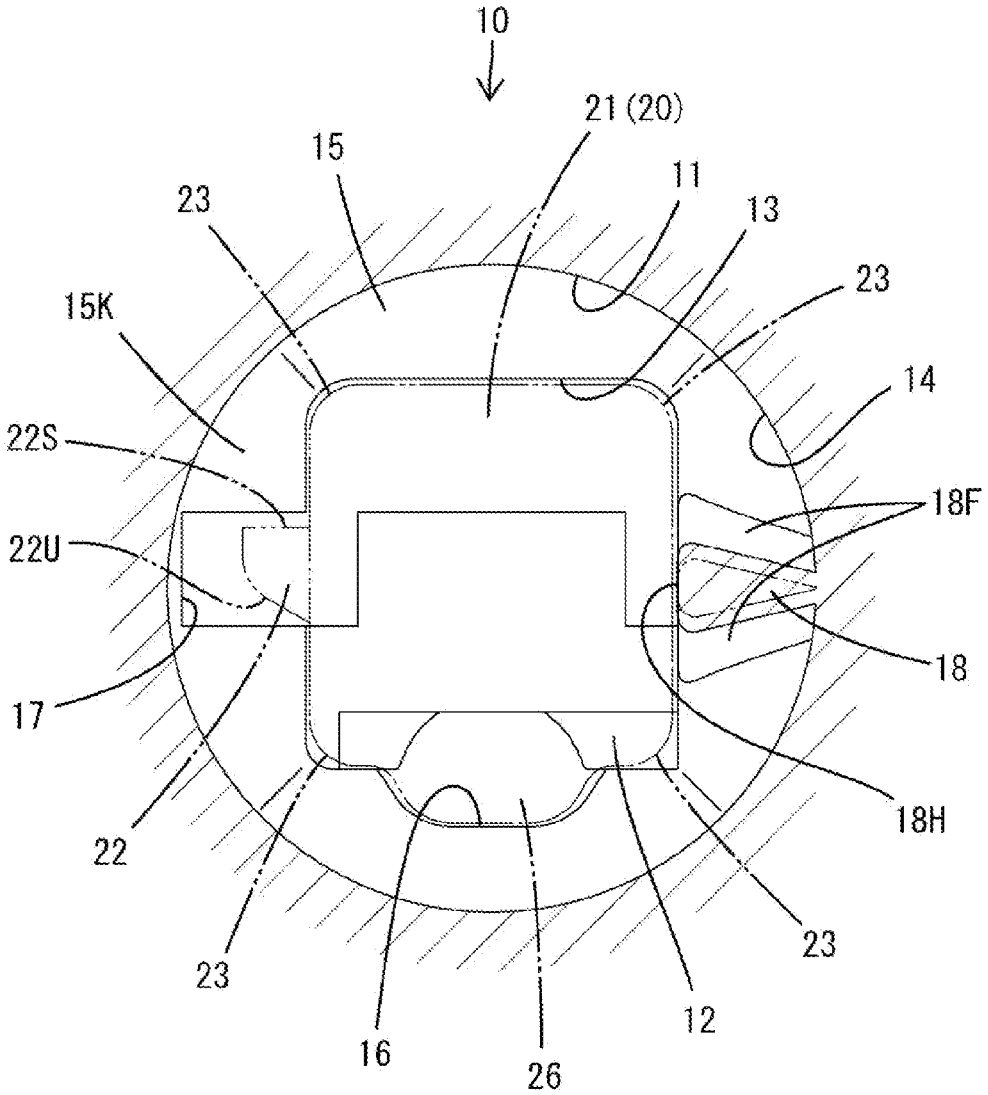
FIG. 6 is a partial enlarged section of the connector housing showing a state where the terminal fitting is inserted in a proper posture in a cavity.

As shown in FIG. 6, each cavity 11 is provided with a first groove portion 16. The stabilizer 26 is insertable and movable forward in the first groove portion 16 when the terminal fitting 20 is inserted in a proper posture into the cavity 11. The first groove portion 16 is provided on a lower surface of the cavity 11. The first groove portion 16 has a curved surface in conformity with the outer shape of the stabilizer 26 and is recessed downwardly. The first groove portion 16 is provided to extend in the front-back direction from the cross-section changing portion 15.

Each cavity 11 is further provided with a second groove portion 17. As shown in FIG. 6, the projection 22 is insertable and movable forward in the second groove portion 17 when the terminal fitting 20 is inserted in the proper posture into the cavity 11. The second groove portion 17 is provided on a wall surface (left wall surface in FIG. 6) on a side where the projection 22 is arranged when the terminal fitting 20 is inserted in the proper posture into the cavity 11. The second groove portion 17 has a rectangular cross-sectional shape when viewed in the front-back direction. The second groove portion 17 has a depth substantially twice the projecting distance of the projection 22. The second groove portion 17 is provided to extend in the front-back direction from the cross-section changing portion 15 similarly to the first groove portion 16.

Each cavity 11 is provided with a guiding portion 18 for contacting the projection and angularly displacing the terminal main body portion 21 when the terminal fitting 20 is inserted in a vertical inverted posture into the cavity 11.

The guiding portion 18 is provided on a wall surface facing the second groove portion 17. Thus, the guiding portion 18 is formed on a side where the projection 22 is arranged when the terminal fitting 20 is inserted in the vertically inverted posture into the cavity 11. The guiding portion 18 is located substantially in a vertical center of each cavity 11 to correspond to the projection 22 of the terminal fitting 20. The guiding portion 18 is provided on a side in front of the main body accommodating portion 13 of each cavity 11.

As shown in FIG. 2, the guiding portion 18 is a projection formed in a range from a front end part of the rubber plug accommodating portion 14 to the front end of the cross-section changing portion 15. A front end of the guiding portion 18 is connected to the main body accommodating portion 13 and a rear end is connected to the rubber plug accommodating portion 14.

Upper and lower surfaces of the guiding portion 18 serve as first inclined surfaces 18F inclined with respect to an inserting direction of the terminal fitting 20. The first inclined surfaces 18F are inclined to widen a distance therebetween toward the front from the rear end of the guiding portion 18. This causes the guiding portion 18 to have a triangular shape long and narrow in the front-back direction and have a width gradually increased toward the front from the rear end when viewed from a central side of the cavity 11. The first inclined surfaces 18F are standing with respect to the rubber plug accommodating portion 14 and the cross-section changing portion 15.

Figure 3:
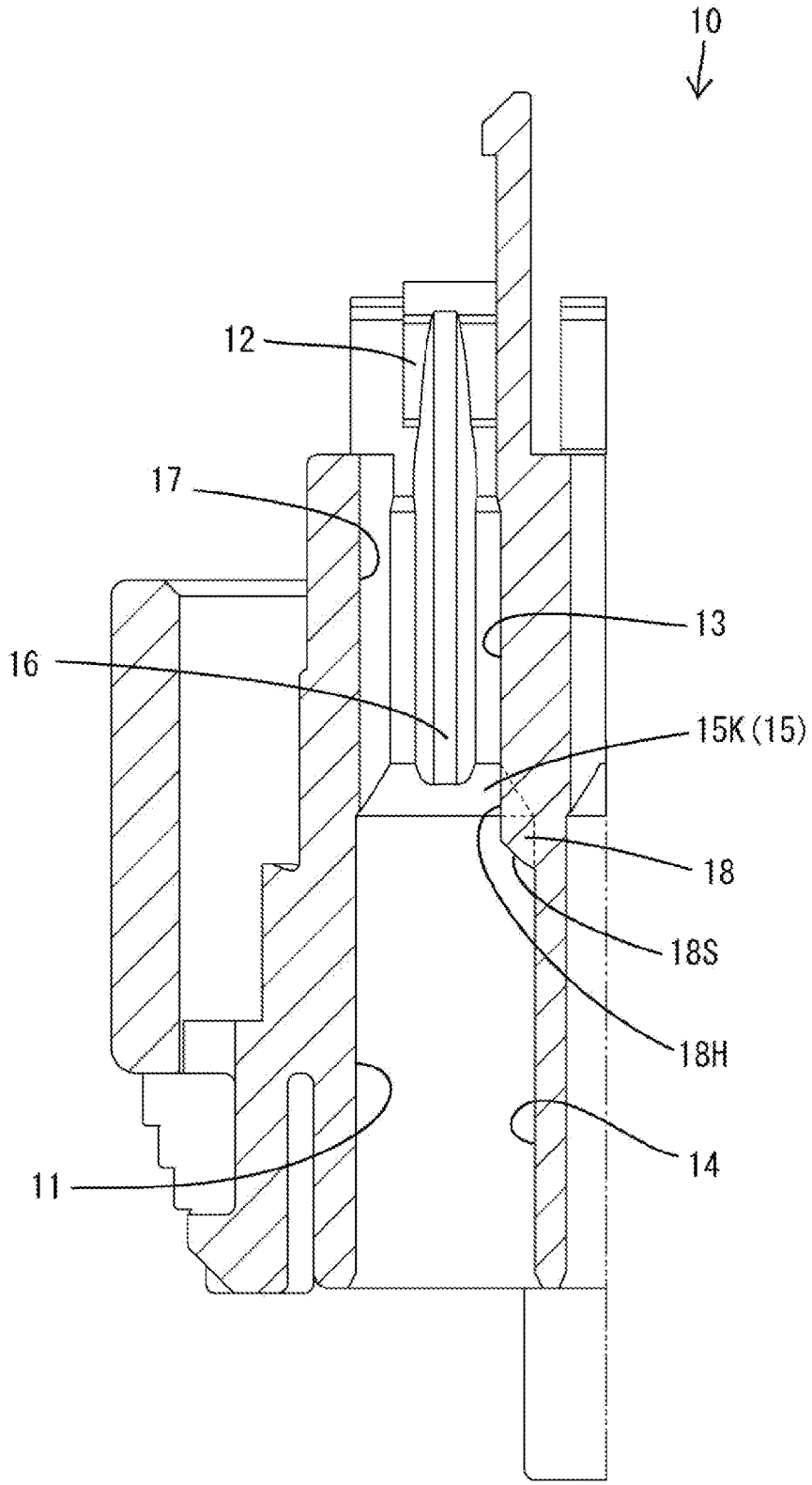
FIG. 3 is a section along B-B of FIG. 1, showing the connector housing.

As shown in FIG. 3, a second inclined surface 18S inclined with respect to the inserting direction of the terminal fitting 20 is formed on a rear end part of the guiding portion 18. The second inclined surface 18S is entirely located in the rubber plug accommodating portion 14 and formed substantially on a part the guiding portion 18 located in the rubber plug accommodating portion 14. The second inclined surface 18S is inclined gradually from the rear end toward the front end to increase a projecting distance of the guiding portion 18 into the cavity. A maximum projecting distance of the guiding portion 18 is equal to a dimension of a step between the rubber plug accommodating portion 14 and the main body accommodating portion 13. The second inclined surface 18S has a smaller dimension than the cross-section changing portion 15 in the front-back direction and is more steeply inclined than the cross-section changing portion 15.

A parallel surface 18H substantially parallel to the inserting direction of the terminal fitting 20 is formed on a part of the guiding portion 18 forward of the second inclined surface 18S as shown in FIG. 3. The parallel surface 18H is connected to the wall surface of the main body accommodating portion 13 without a step.

Next, an example of an operation of accommodating the terminal fittings 20 into the connector housing 10 is described.

When the terminal fitting 20 is inserted in the proper posture into the cavity 11 from behind with the lance locking portion 25 arranged on the same side as the locking lance 12, the terminal main body portion 21 of the terminal fitting 20 passes through the rubber plug accommodating portion 14 of the cavity 11 and reaches the cross-section changing portion 15. Then, as shown in FIG. 6, the stabilizer 26 is inserted into the first groove portion 16 and the projection 22 is inserted into the second groove portion 17 to allow the terminal fitting 20 to move further forward. At this time the terminal main body portion 21 reaches the cross-section changing portion 15, whose width is gradually narrowed from the rubber plug accommodating portion 14 having a large width, and an operator pushes the terminal fitting 20 forward while feeling slight insertion resistance. The terminal fitting 20 moves forward in the main body accommodating portion 13 of the cavity 11 while the locking lance 12 is pressed downwardly to be deflected by the front end part of the terminal main body portion 21. At that time, the stabilizer 26 passes in the first groove portion 16 formed on the upper surface of the locking lance 12. When the terminal main body portion 21 is substantially entirely accommodated in the main body accommodating portion 13 of the cavity 11, the locking lance 12 resiliently returns to be locked to the lance locking portion 25 and the rubber plug G is held in close contact with the rubber plug accommodating portion 14. In this way, the terminal fitting 20 is accommodated and retained at a proper position in the cavity 11. Such an inserting operation of the terminal fitting 20 is successively performed for all the terminal fittings 20.

Figure 7:
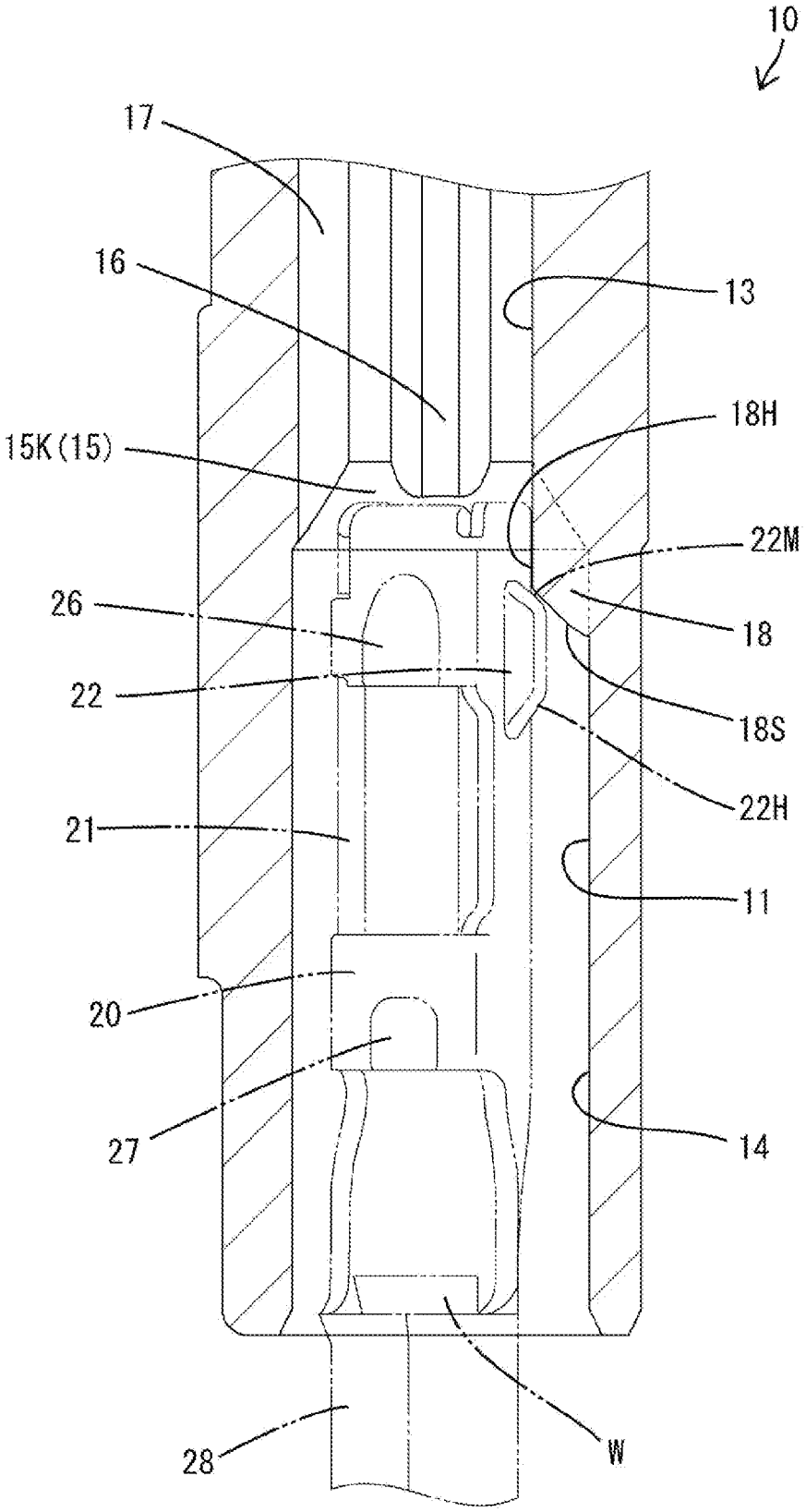
FIG. 7 is a partial enlarged section showing a state where the terminal fitting is inserted in a vertical inverted posture in the cavity.
Figure 8:
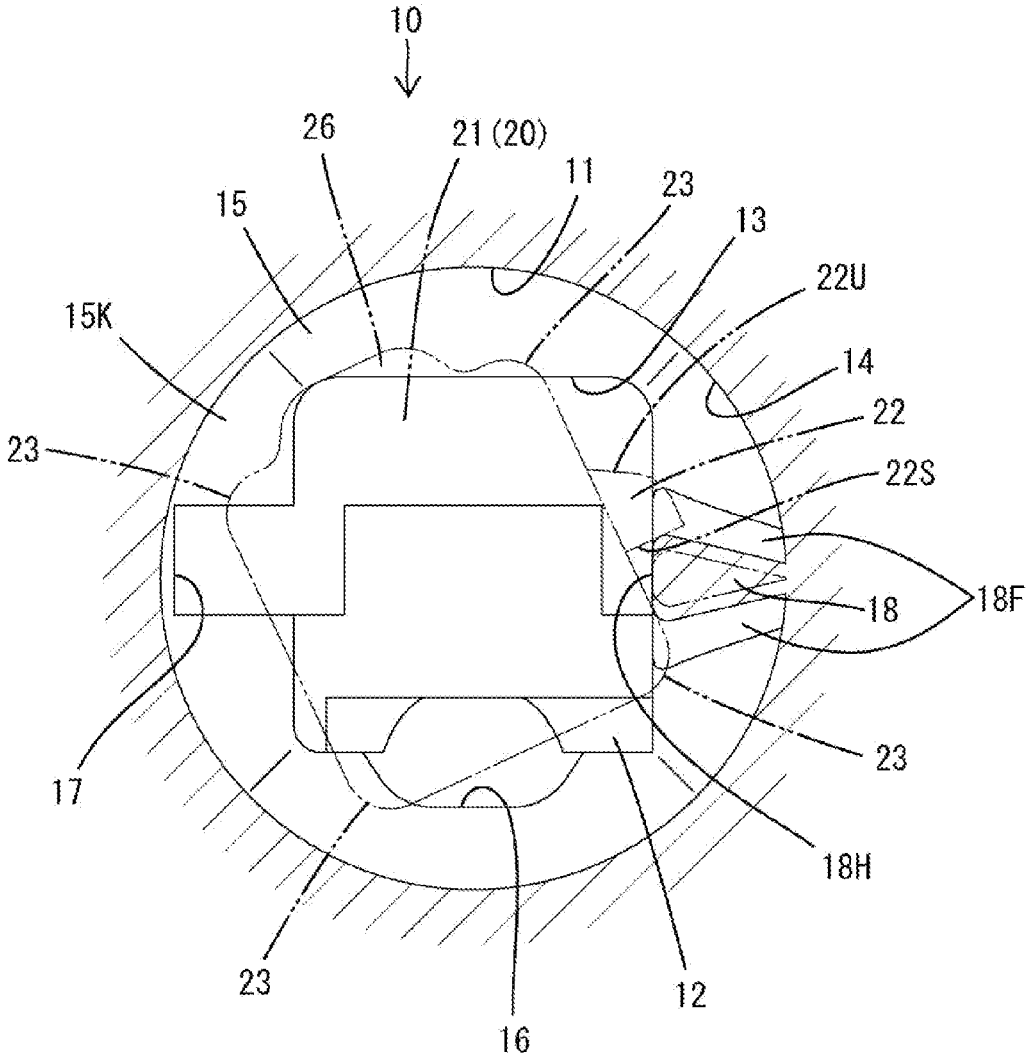
FIG. 8 is a partial enlarged section of the connector housing showing a state where the terminal fitting is rotated counterclockwise by a guiding portion.
Figure 9:
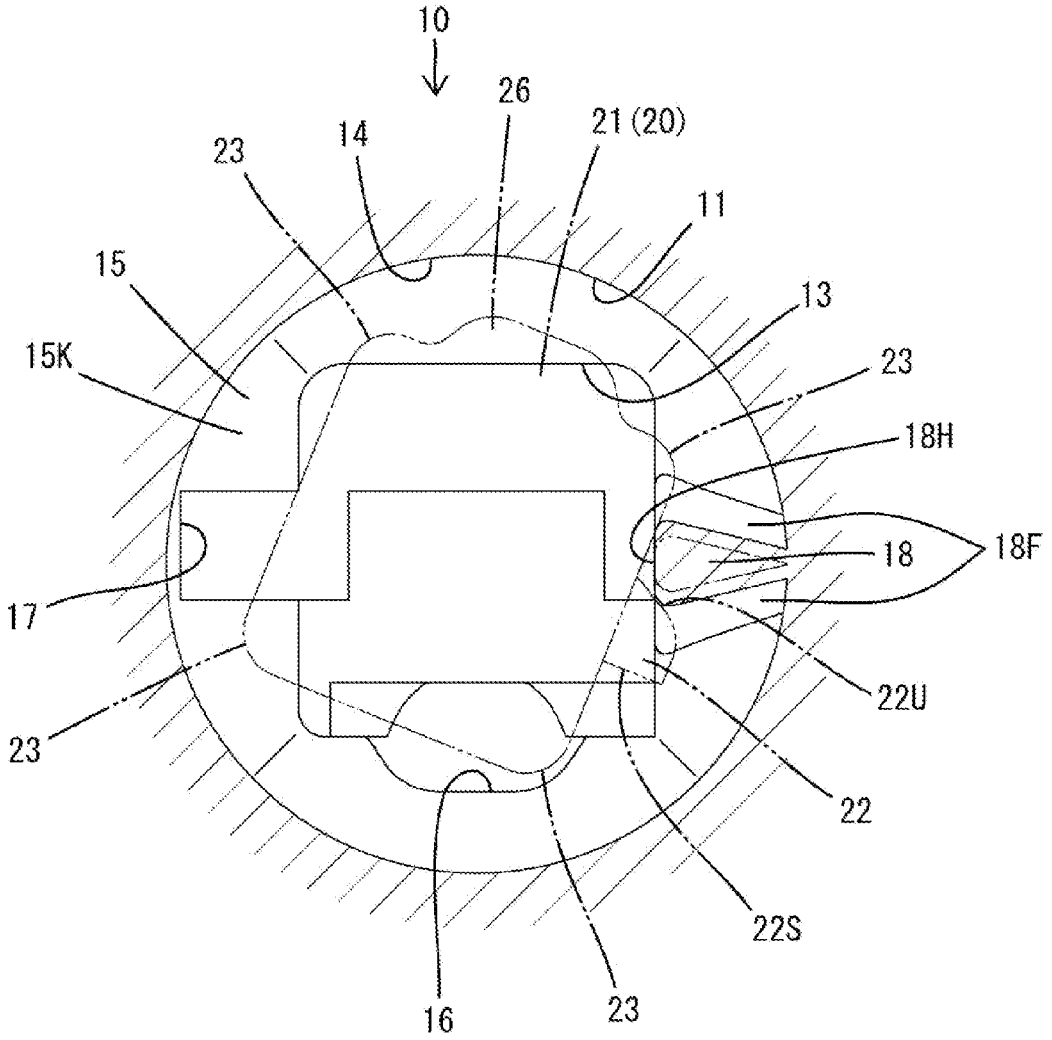
FIG. 9 is a partial enlarged section of the connector housing showing a state where the terminal fitting is rotated clockwise by the guiding portion.

Next, an instance in which the terminal fitting 20 is inserted into the cavity in a vertically inverted posture in which the lance locking portion 25 is arranged on a side opposite to the locking lance 12 will be described. In such a case, as shown in FIG. 7, the projection 22 comes into contact with the second inclined surface 18S of the guiding portion 18 when the front end of the terminal fitting 20 passes through the rubber plug accommodating portion 14 of the cavity 11 and reaches the cross-section changing portion 15. The projection 22 escapes upwardly or downwardly of the guiding portion 18 as shown in FIGS. 8 and 9, respectively, and the terminal main body portion 21 is rotated. The terminal main body portion 21 is inclined to increase an angular displacement thereof by the inclination of the first inclined surface 18F to assume an inclined posture and the four corner portions 23 on the front end of the terminal main body portion 21 come into contact with the inclined surface 15K of the cross-section changing portion 15. In this way, a forward movement of the terminal fitting 20 is prevented even if the operator pushes the terminal fitting 20. Thus, the operator can notice an error in the posture of the terminal fitting 20 and can insert the terminal fitting 20 again in the proper posture.

After the insertion of all the terminal fittings 20 in the proper posture is finished, the operation of accommodating the terminal fittings 20 into the connector housing 10 is completed.

Next, functions and effects of the embodiment configured as described above are described.

The connector housing 10 of this embodiment includes the cavities 11 for accommodating the terminal fittings 20 provided with the projection 22 on the outer side surface of the terminal main body portion 21. The cavity 11 is provided with the main body accommodating portion 13 into which the terminal main body portion 21 is to be accommodated, the second groove portion 17 into which the projection 22 is insertable and movable forward when the terminal fitting 20 is inserted in the proper posture into the cavity 11, and the guiding portion 18 for angularly displacing the terminal main body portion 21 by coming into contact with the projection 22 when the terminal fitting 20 is inserted in the vertically inverted posture into the cavity 11.

According to this configuration, the projection 22 is inserted into the second groove portion 17 to allow a forward movement of the terminal fitting 20 when the terminal fitting 20 is inserted in the proper posture into the cavity 11, and the projection 22 comes into contact with the guiding portion 18 to rotate the terminal main body portion 21 and the corner portions 23 of the terminal main body portion 21 come into contact with a peripheral edge part of the cavity 11 when the terminal fitting 20 is inserted in the vertically inverted posture into the cavity 11. Thus, a contact force when the terminal fitting 20 is inserted in the vertically inverted posture into the cavity 11 is stronger than in the case where only the stabilizer comes into contact with the peripheral edge part of the cavity. Hence, even if the operator continues to push the terminal fitting 20, the forward movement of the terminal fitting 20 is reliably restricted, with the result that the terminal fitting 20 can be reliably prevented from being inserted in the vertically inverted posture into the cavity 11 and accommodated in the cavity 11.

The present invention is not limited to the above described and illustrated embodiment. For example, the following embodiments are also included in the technical scope of the present invention.

Although the shape of the projection 22 provided on the terminal fitting 20 is described in detail in the above embodiment, the shape of the projection is not limited to the above shape and may have any shape.

Although the guiding portion 18 has the first inclined surfaces 18F and the second inclined surface 18S in the above embodiment, there is no limitation to this. For example, a surface substantially perpendicular to the inserting direction of the terminal fitting may be provided on the rear end part of the guiding portion. Further, the opposite upper and lower surfaces of the guiding portion may be surfaces substantially parallel to the inserting direction of the terminal fitting.

Although the terminal fitting 20 is a female terminal fitting in the above embodiment, there is no limitation to this and the terminal fitting may be a male terminal fitting.

Although the cavities 11 are provided in one stage in the above embodiment, there is no limitation to this and the cavities may be provided in two or more stages.

Although the terminal fitting 20 includes the stabilizer 26 in the above embodiment, there is no limitation to this and the terminal fitting may be formed without a stabilizer.

LIST OF REFERENCE SIGNS

10 . . . connector housing
11 . . . cavity
13 . . . main body accommodating portion
17 . . . second groove portion (groove portion)
18 . . . guiding portion
18F . . . first inclined surface (inclined surface)
18S . . . second inclined surface (inclined surface)
20 . . . terminal fitting
21 . . . terminal main body portion
22 . . . projection

What is claimed is:

1. A connector housing having a cavity with opposite front and rear ends spaced apart along an inserting direction, the cavity being configured to accommodate a terminal fitting inserted in the inserting direction, the terminal fitting having a substantially rectangular tubular terminal main body portion provided with a projection on an outer side surface thereof, the connector housing comprising:

a main body accommodating portion formed in the cavity in proximity to the front end of the cavity and into which the terminal main body is to be accommodated;

a groove portion formed in the cavity and into which the projection is insertable and movable forward when the terminal fitting is inserted in a proper posture into the cavity; and a guiding portion provided on a side of the cavity opposite the groove and rearward of the main body accommodating portion in the insertion direction, the guiding portion including upper and lower first inclined guiding surfaces inclined in the inserting direction and inclined to widen a space therebetween in the inserting direction for angularly displacing the terminal main body about an axis extending along the inserting direction by coming into contact with the projection when the terminal fitting is inserted in a vertically inverted posture into the cavity.

2. The connector housing of claim 1, wherein the guiding portion is a projection having an inclined surface.

3. The connector housing of claim 1, wherein the main body accommodating portion has a substantially rectangular cross section, and further comprising:

a plug accommodating portion for accommodating a plug formed on the terminal fitting rearward of the main body accommodating portion in the insertion direction, the plug accommodating portion having a substantially circular cross-section; and a cross-section changing portion between the plug accommodating portion and the main body accommodating portion, the cross-section changing portion having an inclined surface inclined in the insertion direction from the rubber plug accommodating portion for changing the cross-section of the cavity from the substantially circular cross-section of the plug accommodating portion to the substantially rectangular cross-section of the main body accommodating portion and for narrowing a width of the cavity.

4. The connector housing of claim 3, wherein the guiding portion is a projection formed in a range from a front end part of the rubber plug accommodating portion to the front end of the cross-section changing portion.

5. A connector housing having a cavity configured to accommodate a terminal fitting inserted in an inserting direction, the terminal fitting the terminal fitting having a terminal main body provided with a projection on an outer side surface thereof, the connector housing, comprising:

a main body accommodating portion formed in the cavity and into which the terminal main body is to be accommodated;

a groove formed in the cavity into which the projection is insertable and movable forward when the terminal fitting is inserted in a proper posture into the cavity;

a guiding portion provided on a side of the cavity rearward of the main body accommodating portion in the insertion direction for angularly displacing the terminal main body by coming into contact with the projection when the terminal fitting is inserted in a vertically inverted posture into the cavity; and a second groove formed in a surface of the cavity for accommodating a stabilizer formed on a surface of the terminal fitting.

6. The connector housing of claim 1, wherein the guiding portion further includes a second inclined surface rearward of the upper and lower first inclined guiding surfaces and inclined in the inserting direction, the second inclined surface configured to contact the projection when the terminal fitting is inserted into the cavity in the vertically inverted posture.

7. The connector housing of claim 6, wherein the upper and lower first inclined guiding surfaces guide the projecting upwardly or downwardly, respectively and angularly displace the terminal fitting about the axis extending along the inserting direction to prevent insertion of the terminal fitting in the cavity in the vertically inverted posture.

8. The connector housing of claim 6, wherein the inclined surface of the cross-section changing portion contacts the angularly displaced terminal fitting inserted in the vertically inverted posture to prevent further insertion in the inserting direction.

9. A connector for receiving at least one terminal fitting along an inserting direction, the at least one terminal fitting having a substantially rectangular tubular main body portion with a projection projecting from an outer surface thereof, the substantially rectangular tubular main body having a height, a width and diagonal dimensions, the connector comprising:

a connector housing;

at least one cavity formed in the connector housing for accommodating the at least one terminal fitting inserted into the cavity in an inserting direction;

a main body accommodating portion formed in the cavity and having a substantially rectangular cross-section with opposed surfaces defining a height and a width, the substantially rectangular tubular main body being slidably receivable in the main body accommodating portion when the height and width of the main body align with the height and width of main body accommodating portion, height and width dimensions of the main body accommodating portion being less than the diagonal dimensions of the substantially rectangular tubular main body;

a groove formed in the main body accommodating portion for receiving the projection when the terminal fitting is inserted in a proper posture into the cavity; and a guiding portion formed on a side of the cavity rearward of the main body accommodating portion in the insertion direction for contacting the projection when the terminal fitting is inserted in a vertically inverted posture into the cavity, the guiding portion and the projection being configured so that contact of the guiding portion with the projection angularly displaces the terminal main body around an axis extending along the insertion direction and into an orientation where the diagonals of the terminal main body align with the height and width of the main body accommodating portion for preventing insertion.

10. The connector of claim 9, wherein the guiding portion is a projection having at least one inclined surface.

11. The connector of claim 9, further comprising a second groove formed in a surface of the cavity for accommodating a stabilizer formed on a surface of the terminal fitting.

12. The connector of claim 9, wherein the guiding portion includes upper and lower first inclined guiding surfaces inclined in an inserting direction of the terminal fitting and inclined to widen a space therebetween in the inserting direction, and a second inclined surface rearward of the upper and lower first inclined guiding surfaces and inclined in the inserting direction, the second inclined surface being configured to contact the projection when the terminal fitting is inserted into the cavity in the vertically inverted posture.

13. The connector of claim 12, wherein the upper and lower first inclined guiding surfaces guide the projecting upwardly or downwardly and angularly displace the terminal fitting to prevent insertion of the terminal fitting in the cavity in the vertically inverted posture.

* * * * *